US007938189B2

(12) United States Patent
Rytlewski

(10) Patent No.: US 7,938,189 B2
(45) Date of Patent: May 10, 2011

(54) PRESSURE PROTECTION FOR A CONTROL CHAMBER OF A WELL TOOL

(75) Inventor: Gary Rytlewski, League City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 962 days.

(21) Appl. No.: 11/308,036

(22) Filed: Mar. 3, 2006

(65) Prior Publication Data

US 2007/0204998 A1 Sep. 6, 2007

(51) Int. Cl.
*E21B 34/04* (2006.01)

(52) U.S. Cl. ..... 166/337; 166/317; 166/321; 166/368; 166/375; 166/386; 285/145.4; 285/302

(58) Field of Classification Search ..... 166/337, 166/317, 321, 366–368, 373–375, 381, 383, 166/386; 277/323, 324; 285/95, 96, 145.1, 285/145.4, 302

See application file for complete search history.

(56) References Cited

U.S. PATENT DOCUMENTS

| | | | | |
|---|---|---|---|---|
| 4,105,075 | A * | 8/1978 | Helmus | 166/321 |
| 4,478,284 | A * | 10/1984 | Tomm et al. | 166/297 |
| 4,577,692 | A * | 3/1986 | Reardon | 166/321 |
| 4,911,242 | A * | 3/1990 | Hromas et al. | 166/317 |
| 5,207,272 | A * | 5/1993 | Pringle et al. | 166/66.6 |
| 6,186,227 | B1 * | 2/2001 | Vaynshteyn et al. | 166/120 |
| 6,293,346 | B1 * | 9/2001 | Patel | 166/373 |
| 6,302,216 | B1 * | 10/2001 | Patel | 166/375 |
| 6,450,263 | B1 * | 9/2002 | Schwendemann | 166/373 |
| 6,736,012 | B1 * | 5/2004 | Beall et al. | 73/709 |
| 7,252,162 | B2 * | 8/2007 | Akinlade et al. | 175/72 |
| 2002/0129942 | A1 * | 9/2002 | Wetzel et al. | 166/332.5 |
| 2005/0189107 | A1 * | 9/2005 | McVay et al. | 166/242.1 |
| 2005/0269096 | A1 * | 12/2005 | Milberger et al. | 166/308.1 |
| 2006/0157253 | A1 * | 7/2006 | Robichaux et al. | 166/359 |

FOREIGN PATENT DOCUMENTS

| | | | |
|---|---|---|---|
| EP | 1002933 | A2 | 5/2000 |
| EP | 1002933 | A3 | 5/2000 |
| GB | 2397316 | A | 7/2004 |
| WO | 99/31351 | A1 | 6/1999 |
| WO | 03/054342 | A1 | 7/2003 |

* cited by examiner

*Primary Examiner* — Thomas A Beach
*Assistant Examiner* — Matthew R Buck
(74) *Attorney, Agent, or Firm* — Kevin B. McGoff; Rodney V. Warfford; Tim Curington

(57) ABSTRACT

A technique includes providing a chamber in a well tool to receive pressure to control an operation of the tool. The technique includes providing a seal to isolate the chamber from well pressure. The technique also includes providing a pressure relief mechanism to relieve pressure from the chamber in response to the pressure exceeding a threshold.

20 Claims, 4 Drawing Sheets

PRESSURE PROTECTION FOR A CONTROL CHAMBER OF A WELL TOOL

BACKGROUND

The invention generally relates to pressure protection for a control chamber of a well tool.

A well tool may be remotely controlled from the surface of a well using one of many different control schemes. One type of control involves the use of a control chamber, which may be pressurized (via a control line, for example) to change the state of the tool.

As a more specific example, the tool may be a ball valve, and the control chamber may be pressurized for purposes of closing the valve. The ball valve typically includes a ball valve element that controls the flow of well fluid through a main well fluid passageway of the valve. The control chamber typically is located in a housing of the tool, which surrounds the well fluid passageway, and a seal may isolate the control chamber from the main passageway.

During normal operation, the pressure inside the control chamber remains within a range that may be significantly below the pressure of the well fluid. However, because there is a possibility that the seal that is supposed to isolate the control chamber from the well fluid may leak, the control chamber typically is designed to withstand the higher well pressure. Such a design typically means that the housing of the control chamber is made significantly thicker than would otherwise be needed to withstand the lower control chamber pressure. In general, a thicker housing translates into a smaller cross-sectional area for the well fluid passageway of the tool.

Thus, there is a continuing need for better ways to safeguard a well tool against a seal leak.

SUMMARY

In an embodiment of the invention, a technique includes providing a chamber in a well tool to receive pressure to control an operation of the tool. The technique includes providing a seal to isolate the chamber from well pressure. The technique also includes providing a pressure relief mechanism to relieve pressure from the chamber in response to the pressure exceeding a threshold.

In another embodiment of the invention, a well tool includes a chamber, a seal and a pressure relief mechanism. The chamber receives pressure to control an operation of the tool, and the seal isolates the chamber from well pressure. The pressure relief mechanism is adapted to relieve pressure from the chamber in response to the pressure exceeding a threshold.

In yet another embodiment of the invention, a test tree for a subsea well includes a string that is adapted to be installed inside a blowout preventer and a tool that is part of the string. The tool includes a chamber to receive pressure to control an operation of the tool and a seal to isolate the chamber from well pressure. The tool also includes a pressure relief mechanism to relieve pressure from the chamber in response to the pressure exceeding a threshold pressure.

Advantages and other features of the invention will become apparent from the following drawing, description and claims.

DETAILED DESCRIPTION

Figure 1:
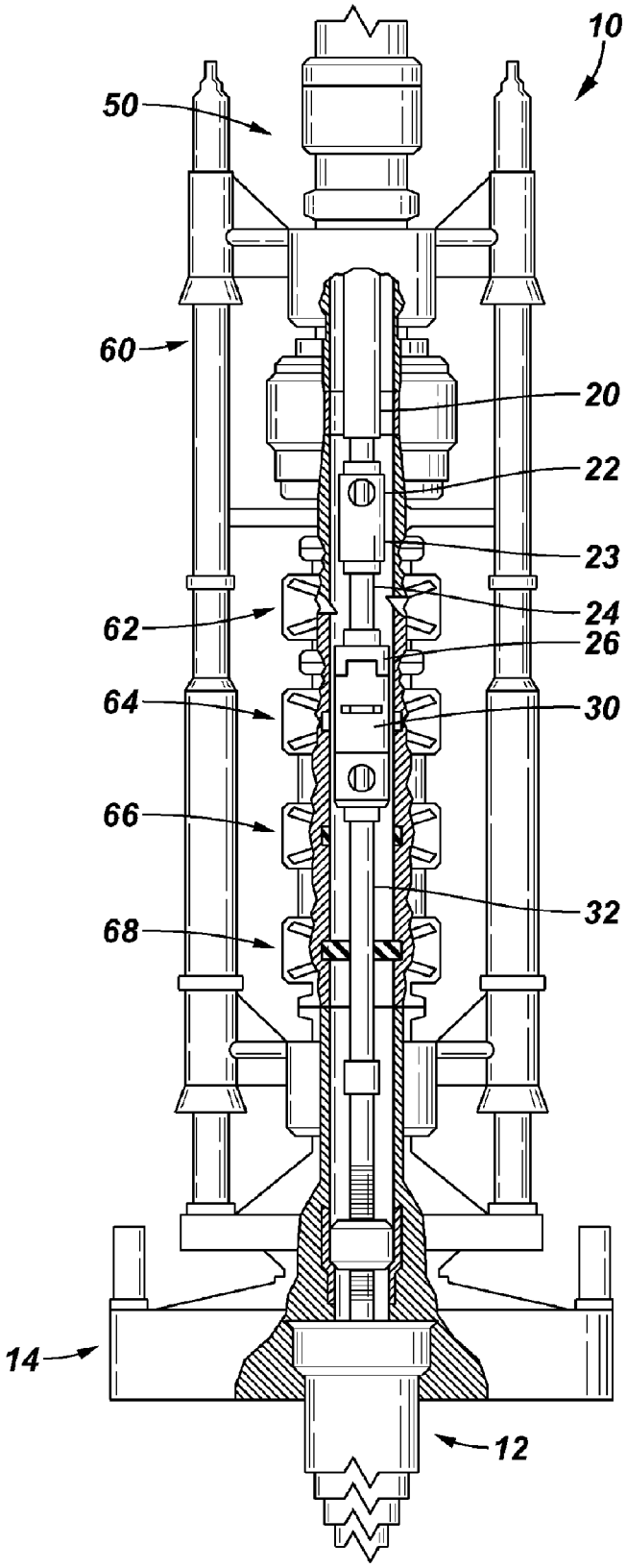
FIG. 1 is a schematic diagram of a blowout preventer stack and a test tree string positioned inside the stack according to an embodiment of the invention.

FIG. 1 depicts a subsea well 10 in accordance with some embodiments of the invention. The subsea well 10 includes a blowout preventer (BOP) stack 14 that is attached to a well head 12 of the well 10. A riser 50 is connected to the top of the BOP stack 14 and extends to a surface platform (not depicted in FIG. 1). Also schematically depicted in FIG. 1 is a subsea test and command completion string 20, a string that may be run through the inner passageway of the BOP stack 14 and may be adapted to be mounted inside the passageway for purposes of performing several functions, such as setting a tubing hanger, injecting chemicals and monitoring temperature and pressure inside the well 10.

As described further below, the string 20 includes at least one tool that is operated in response to pressure in a control chamber. Instead of having a design in which a housing of the control chamber is designed to withstand well pressure (should a seal leak), the tool includes a pressure relief mechanism at the control chamber to relieve excess pressure. Therefore, the control chamber may be designed to withstand a much lower pressure; and as a result, the diameter of the internal well fluid passageway of the string 20 is maximized.

In accordance with some embodiments of the invention, the string 20 includes such features as a retainer valve 22, a bleedoff valve 23, a shear sub 24, a latch assembly 26, a valve assembly 30 and a slick joint 32. The valve assembly 30, which may include a ball valve and flapper valves (as examples), forms part of a well shut off system. In general, the purpose of the shut off system is to hold pressures exerted from inside or outside the system; and the valves of the shut off system operate in a particular order to ensure fluid isolation.

As a more specific example, in accordance with some embodiments of the invention, the shutoff system may be operated in the following manner for purposes of disengaging the upper section of the string 20. First, valves of the valve assembly 30 shut off fluid rising from the well, and next, the retainer valve 22 closes to contain fluids in the pipe that leads to the surface. Subsequently, the small amount of fluid that may be trapped between the two valves is bled off into the riser 50 via the bleedoff valve 23. Then, the latch assembly 26 may be used to disconnect the upper section of the string 20, which can be pulled clear of the BOP stack 14.

In accordance with some embodiments of the invention, the components of the string 20 are aligned to correspond with components of the BOP stack 14. For example, in accordance with some embodiments of the invention, the shear sub 24 is aligned with shear rams 62 of the BOP stack 14 to prevent relatively easy shearing of the string 20 in the case of a blowout condition. Additionally, the slick joint 32 of the string 20 is aligned with upper 66 and lower 68 pipe rams of the BOP stack 14 for purposes of forming an annular seal should a blowout condition arise.

Among the other features depicted in FIG. 1, in accordance with some embodiments of the invention, the BOP stack 14 includes various conduits 60 that communicate fluid received in the passageway of the BOP stack 14 outside of the test string 20 to the riser 50.

It is noted that the string 20 is one out of many possible embodiments of the invention, which include a tool that operates in response to the pressurization/de-pressurization of a control chamber. For example, in accordance with other embodiments of the invention, the chamber may be part of a downhole tool of a subterranean well. Additionally, the chamber may be part of a well tool that is part of a test string or may be part of a tool that is part of a permanent completion. Thus, many variations are possible and are within the scope of the appended claims.

In accordance with some embodiments of the invention, the string 20 may include multiple well tools that are operated in response to a control pressure. In this regard, an electrical signal may be communicated to the string 20 via a logging wireline (for example), and controls (not shown in FIG. 1) of the test string 20 may form corresponding hydraulic pressures in control lines for purposes of controlling various tool operations. Each control line may extend to a control chamber of a particular tool of the string 20.

Thus, the communication of pressure to a particular control chamber via the control line may cause a tool to perform a desired operation. For example, to open a valve of the valve assembly 30, a control chamber associated with that valve may be pressurized to a predefined pressure threshold for purposes of displacing a mandrel of the valve to cause the valve to open.

The control chamber of a particular tool may have a significantly lower pressure than the pressure of the well fluid in the test string 20. For example, the control chamber may be pressurized to near 7,500 p.s.i. for purposes of initiating a tool operation; and in contrast, the well pressure may be near 20,000 p.s.i. or greater.

The tool therefore may contain a seal (one or more o-rings, for example) for purposes of isolating the control chamber from the well fluid pressure. However, it is possible that the seal may leak, and if a leak does occur, the well fluid pressure may be communicated into the control chamber. If the control chamber housing is not designed to withstand the well fluid pressure, then a catastrophic event may occur downhole, such as the disintegration of the tool.

Therefore, conventionally, the housing that contains the control chamber is designed to withstand the well fluid pressure. However, for certain applications, the well pressure (such as a pressure that equals or exceeds 20,000 p.s.i., as an example) may be high enough to require a significantly thick housing, which may severely restrict the cross-section of the inner well fluid passageway through the string 20. Instead of using such an approach, as mentioned above, a pressure relief mechanism is built into the control chamber in lieu of designing the chamber's housing to withstand the well pressure. Due to this arrangement, the inner diameter of the string's passageway is maximized, and safeguard measures are thus, implemented to protect the tool in the case of seal leakage.

Figure 2:
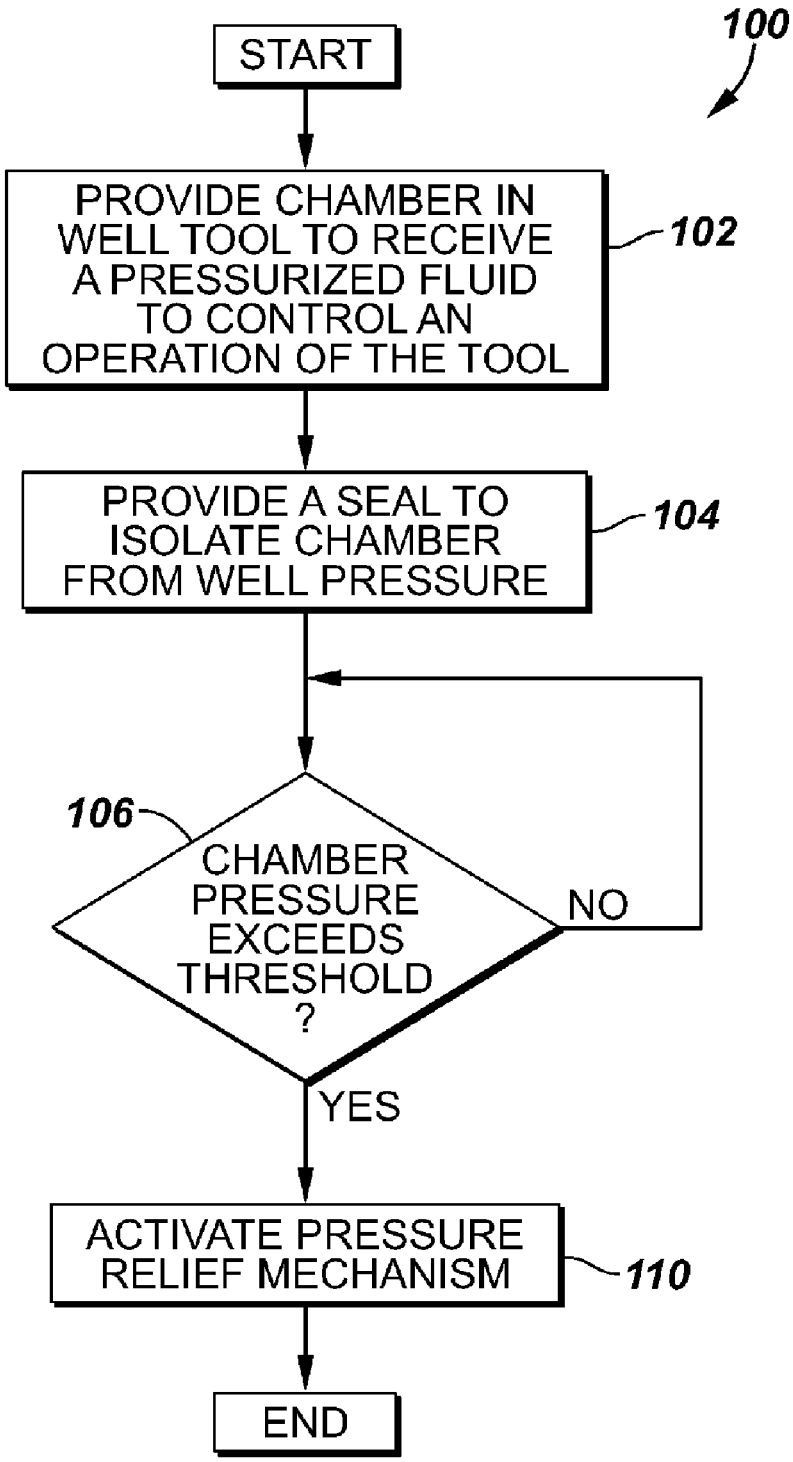
FIG. 2 is a flow diagram depicting a technique to protect a control chamber of the test tree string from over-pressurization according to an embodiment of the invention.

To summarize, in accordance with some embodiments of the invention, a technique 100 (see FIG. 2) includes providing a chamber in a well tool to receive a pressurized fluid to control an operation of the tool, pursuant to block 102. A seal is provided (block 104) to isolate the chamber from well pressure. In response to the chamber pressure exceeding a threshold (diamond 106), a pressure relief mechanism is activated (block 110) to relieve pressure in the control chamber.

Figure 3:
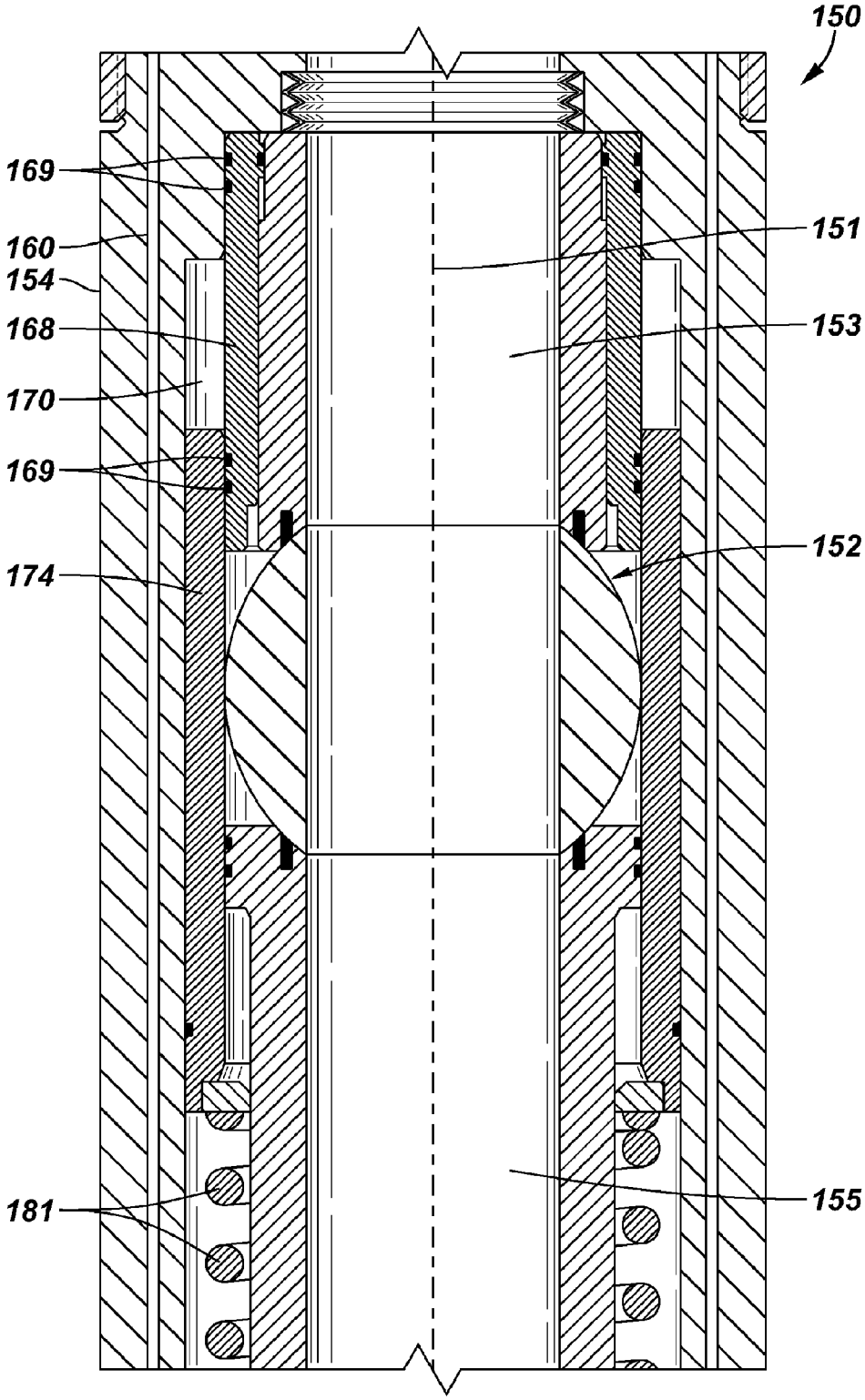
FIGS. 3 and 4 are different cross-sectional diagrams of a tool of the test tree string according to an embodiment of the invention.

As a more specific example, in accordance with some embodiments of the invention, the valve assembly 30 (see FIG. 1) may include a ball valve, an embodiment 150 of which is depicted in FIG. 3. Referring to FIG. 3, the ball valve 150 may include a ball valve element 152 (depicted in FIG. 3 as being opened), which is rotated between open and closed positions by an operator mandrel 174 for purposes of controlling well fluid communication between a well fluid passageway 153 above the element 152 and a well fluid passageway 155 below the element 152. The operator mandrel 174 is concentric with a longitudinal axis 151 of the ball valve 150 and slides up and down the longitudinal axis 151 for purposes of opening and closing the ball valve element 152.

Near its uppermost point of travel, the operator mandrel 174 causes the ball valve element 152 to close off communication through the ball valve 150 (i.e., isolate the well fluid passageways 153 and 155). However, in its downward position (depicted in FIG. 3), the ball valve element 152 is open to establish fluid communication between the well fluid passageway 153 and 155.

The ball valve 152 is biased closed via a coiled spring 181 that resides below a bottom end of the operator mandrel 174. The top end of the operator mandrel 174 is in communication with a control chamber 170, which receives control fluid (and pressure) via a control line 160. In the absence of a significant pressure in the control chamber 170, the coiled spring 181 pushes the operator mandrel 174 upward to rotate the ball element 174 and close off the ball valve 150. Therefore, when the pressure in the control chamber 170 is below a predetermined threshold, the ball valve 150 closes.

For purposes of opening the ball valve 150, the pressure to the control chamber 170 is increased, which causes the operator mandrel 174 to move downwardly, rotate the ball valve element 152 and thus, open the ball valve 150.

As depicted in FIG. 3, in accordance with some embodiments of the invention, the control line 160 may be formed via a longitudinal passageway that extends through a housing section 154 of the ball valve 150. The control chamber 170 may be formed from a radially recessed portion on the interior face of the housing section 154, the top surface of the operator mandrel 174 and the interior face of a seal sleeve 168. In accordance with some embodiments of the invention, o-rings 169 may be located between the outer surface of the seal sleeve 168 and an inner surface of the housing section 154 to isolate the control chamber 170 from well pressure. Should one of the o-rings 168 leak, well fluid pressure is communicated to the control chamber 170; and as a result, if measures are not undertaken to control this pressure, the housing section 154 or another part of the ball valve 150 may rupture, thereby causing a catastrophic failure within the well.

Figure 4:
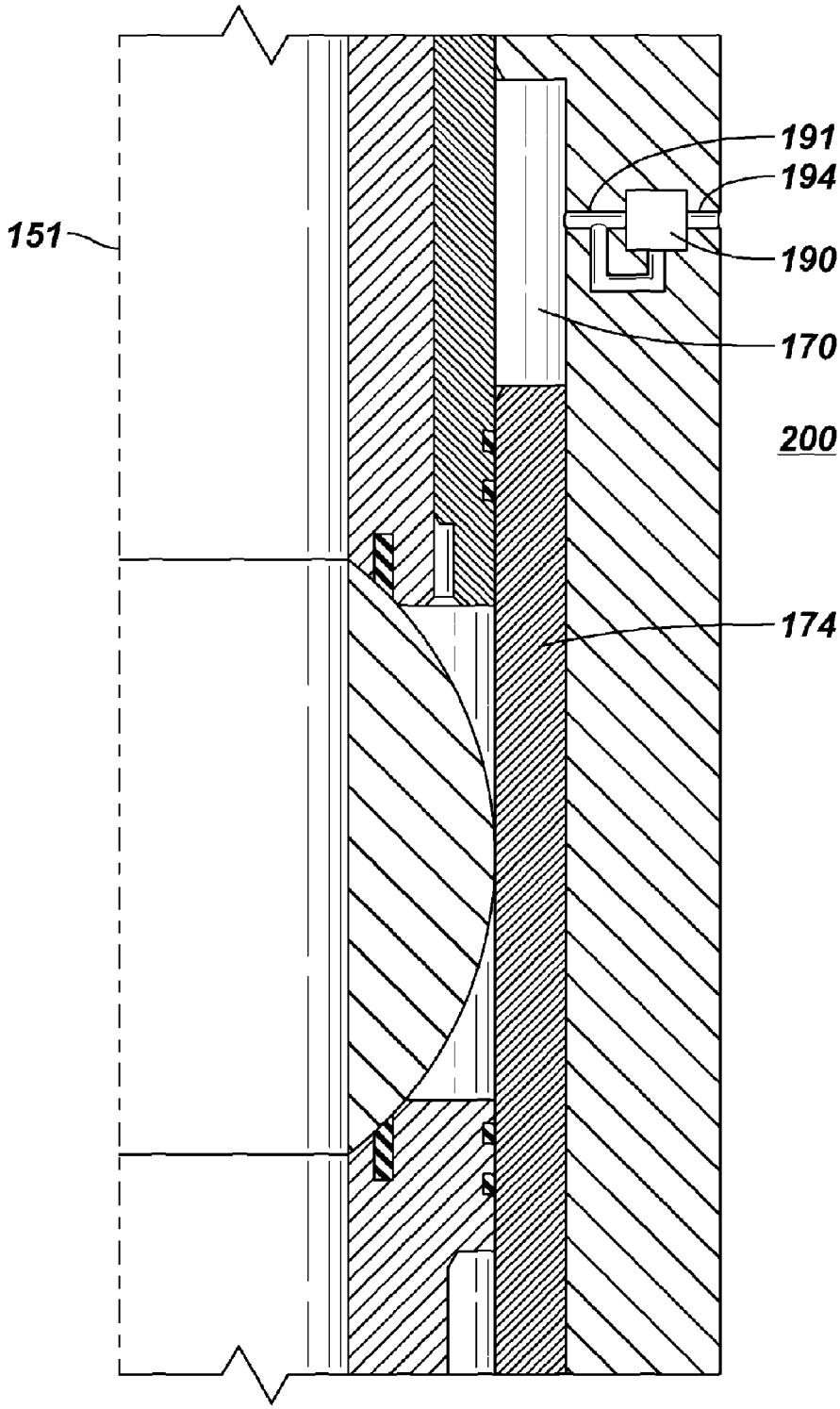

FIG. 4 depicts another cross-sectional view of a section of the ball valve 150, which illustrates a pressure relief mechanism 190 to regulate the maximum pressure that may be experienced by the housing of the control chamber 170, in accordance with some embodiments of the invention. The pressure relief mechanism 190 is located in the housing section 154 where the control chamber 170 is formed.

The pressure relief mechanism 190 controls fluid communication between the control chamber 170 and an exterior region 200 outside of the housing section 154. In other words, the pressure relief mechanism 190 controls communication between the control chamber 170 and the interior space of the riser 50 outside of the string 20 (see FIG. 1), in accordance with some embodiments of the invention. Therefore, a radial port 191 is formed in the housing section 154 to establish communication between the control chamber 170 and the pressure relief mechanism 190. Another radial port 194 is formed in the housing 154 between the pressure relief mechanism 190 and the exterior region 200.

Therefore, in accordance with some embodiments of the invention, the pressure relief mechanism 190 is connectedly directed to the control chamber 170 (is not connected via the control line 160, for example) to relieve pressure at the chamber 170 in the event of seal failure. The pressure relief mechanism's proximity to the control chamber 170 minimizes the response time of the mechanism to a pressure surge that is caused by a seal leak.

The pressure relief mechanism 190 may be a pressure relief valve that has a preset pressure threshold such that when the pressure in the control chamber 170 exceeds the threshold, the pressure relief valve opens to establish a flow out of the chamber 170 and into the riser passageway. This pressure threshold may be at the rating of the control chamber 170, in accordance with some embodiments of the invention. For example, the rating of the control chamber may be approximately 7,500 p.s.i., and the well pressure where the string 20 operates may be near 20,000 p.s.i. Therefore, if the seal to the control chamber 170 should fail and a predefined pressure threshold at or slightly below the 7,500 p.s.i. rating is exceeded, the pressure relief valve opens to relieve pressure in the chamber 170. Otherwise, the pressure relief valve remains closed.

In other embodiments of the invention, the pressure mechanism 190 may be a rupture disk, which is designed to be breached, or rupture, at a predefined pressure threshold, such as a pressure at or slightly below the pressure rating of the control chamber. A rupture disk has the advantage of allowing a quicker release than a pressure relief valve.

Referring to FIGS. 3 and 4, the ball valve 150 operates in the following manner when the seal that isolates the control chamber from the well fluid pressure fails. Upon seal failure, the pressure relief mechanism 190 opens communication between the control chamber 170 and the riser passageway. This open communication, in turn, decreases the pressure in the control chamber 190 to a point at which the coiled spring 181 pushes the operator mandrel 174 to its uppermost point of travel to close the ball valve element 152 and thus, close well fluid communication through the ball valve 150. At this point, the well fluid passageways 153 and 155 are isolated from each other. As a result, the well below the ball valve 150 is sealed off, thereby preventing re-opening of the ball valve 150 and more importantly, preventing a blowout or other catastrophic well event.

Directional turns and terms of orientation, such as "up," "down," etc. are used herein for reason of convenience to describe certain embodiments of the invention. However, it is understood that these orientations are not needed to practice the invention; and therefore, other orientations and directions may be used in accordance with other embodiments of the invention. For example, in accordance with other embodiments of the invention, the operator mandrel 174 may move in a downward direction to close the ball valve element 152 or may move in a lateral direction in other embodiments of the invention. Therefore, many variations are possible and are within the scope of the appended claims.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method comprising:

providing a chamber in a well tool to receive pressure through a control line to control an operation of the tool;

providing a seal to isolate the chamber from well pressure; and performing corrective action in response to leakage occurring around the seal that would otherwise cause a pressure in the chamber to increase to the well pressure, comprising operating a pressure relief mechanism to relieve pressure from the chamber in response to the pressure exceeding a threshold to maintain pressure in the chamber substantially below the well pressure;

providing a fluid communication path that extends from a region inside of the tool to a region outside of the tool having a pressure substantially less than the well pressure; and disposing the pressure relief mechanism in the path to control fluid flow through the path.

2. The method of claim 1, further comprising:

adapting the pressure relief mechanism to relieve the pressure in response to a breach of the seal.

3. The method of claim 2, further comprising:

adapting the pressure relief mechanism to relieve the pressure in response to the pressure in the chamber approaching the well pressure.

4. The method of claim 1, wherein the act of performing corrective action comprises routing fluid in the chamber to a subsea riser.

5. The method of claim 1, wherein the act of performing corrective action comprises routing the fluid communication path through a housing of the tool.

6. The method of claim 1, further comprising: pressuring the control line to control a valve.

7. The method of claim 1, wherein the pressure relief mechanism comprises one of a rupture disk and a pressure relief valve.

8. An apparatus comprising:

a control line;

a chamber to receive pressure communicated through the control line to control an operation of a well tool;

a seal to isolate the chamber from well pressure; and a pressure relief mechanism to relieve pressure from the chamber in response to a breach of the seal to maintain the pressure of the chamber substantially below the well pressure;

a housing containing the chamber; and a fluid communication path located at least partially in the housing and being in fluid communication with a region having a pressure substantially less than the well pressure, wherein the pressure relief mechanism is located in the path to control fluid flow through the path.

9. The apparatus of claim 8, wherein the pressure relief mechanism is adapted to relieve the pressure in response to a breach of the seal.

10. The apparatus of claim 8, wherein the pressure relief mechanism is adapted to relieve the pressure in response to the pressure in the chamber approaching the well pressure.

11. The apparatus of claim 8, wherein the region comprises a region inside a subsea riser.

12. The apparatus of claim 8, wherein the fluid communication path extends through the housing.

13. The apparatus of claim 8, wherein the pressure relief mechanism comprises one of a rupture disk and a pressure relief valve.

14. A subsea test tree comprising:

a control line;

a string adapted to be mounted inside a blowout preventer; and a tool that is part of the test tree, the tool comprising:

a chamber to receive pressure communicated through the control line to control an operation of the tool;

a seal to isolate the chamber from well pressure; and a pressure relief mechanism to relieve pressure from the chamber in response to a breach of the seal to maintain the pressure of the chamber substantially below the well pressure.

15. The subsea test tree of claim 14, wherein the pressure relief mechanism is adapted to relieve the pressure in response to a breach of the seal.

16. The subsea test tree of claim 14, wherein the pressure relief mechanism is adapted to relieve the pressure in response to the pressure in the chamber reaching the well pressure.

17. The subsea test tree of claim 14, further comprising:

a housing containing the chamber; and a fluid communication path located at least partially in the housing and being in fluid communication with a region having a pressure substantially less than the well pressure, wherein the pressure relief mechanism is located in the path to control fluid flow through the path.

18. The subsea test tree of claim 17, wherein the region comprises a region inside a subsea riser.

19. The subsea test tree of claim 17, wherein the fluid communication path extends through the housing.

20. The subsea test tree of claim 14, wherein the pressure relief mechanism comprises one of a rupture disk and a pressure relief valve.

* * * * *